US006945321B2

(12) United States Patent
Hosoya et al.

(10) Patent No.: US 6,945,321 B2
(45) Date of Patent: Sep. 20, 2005

(54) HEAT EXCHANGERS

(75) Inventors: Kazuki Hosoya, Isesaki (JP); Akimichi Watanabe, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/053,582

(22) Filed: Jan. 24, 2002

(65) Prior Publication Data

US 2002/0139519 A1 Oct. 3, 2002

(30) Foreign Application Priority Data

Feb. 15, 2001 (JP) ..... P2001-038539

(51) Int. Cl.[7] ..... F28F 13/18
(52) U.S. Cl. ..... 165/133; 165/166; 165/134.1
(58) Field of Search ..... 165/133, 134.1, 165/166, 167, 914, 905, 76, 79

(56) References Cited

U.S. PATENT DOCUMENTS

| | | | | | |
|---|---|---|---|---|---|
| 2,569,097 | A | | 9/1951 | Grange et al. | |
| 3,310,868 | A | | 3/1967 | La Porte et al. | |
| 3,440,712 | A | | 4/1969 | Stroup et al. | |
| 3,489,448 | A | | 1/1970 | Nagara et al. | |
| 3,498,371 | A | * | 3/1970 | Zygiel | 165/164 |
| 3,590,917 | A | * | 7/1971 | Huber et al. | 165/166 |
| 3,666,006 | A | * | 5/1972 | Valyi | 165/164 |
| 3,857,164 | A | | 12/1974 | Chartet | |
| 3,893,611 | A | | 7/1975 | Chartet | |
| 4,214,925 | A | | 7/1980 | Arita et al. | |
| 4,421,789 | A | | 12/1983 | Kaneko et al. | |
| 4,428,418 | A | * | 1/1984 | Beasley et al. | 165/76 |
| 4,501,387 | A | | 2/1985 | Hoyer | |
| 4,571,352 | A | | 2/1986 | Aoki | |
| 4,601,089 | A | * | 7/1986 | Gal | 29/890.042 |
| 4,732,311 | A | | 3/1988 | Hasegawa et al. | |
| 4,774,106 | A | | 9/1988 | Kozono | |
| 4,781,320 | A | | 11/1988 | Fujiyoshi | |
| 4,804,713 | A | * | 2/1989 | Akiyama | 525/185 |
| 4,828,616 | A | * | 5/1989 | Yamasoe | 106/14.13 |
| 4,830,101 | A | * | 5/1989 | Ohara et al. | 165/133 |
| 4,831,701 | A | | 5/1989 | Yutaka | |
| 4,901,907 | A | | 2/1990 | Enokido et al. | |
| 4,901,908 | A | | 2/1990 | Negura et al. | |
| 4,989,775 | A | | 2/1991 | Shimajiri et al. | |
| 5,174,490 | A | | 12/1992 | Koisuka et al. | |
| 5,203,402 | A | * | 4/1993 | Nishishita et al. | 165/133 |
| 5,399,192 | A | | 3/1995 | Yamasoe | |
| 5,478,872 | A | * | 12/1995 | Yamasoe et al. | 524/45 |
| 5,616,388 | A | | 4/1997 | Tatsuno et al. | |
| 5,800,673 | A | * | 9/1998 | Okuda et al. | 159/28.6 |

FOREIGN PATENT DOCUMENTS

| | | | | |
|---|---|---|---|---|
| EP | 0676250 | | 10/1995 | |
| EP | 0911427 | | 4/1999 | |
| EP | 0976486 | | 2/2000 | |
| EP | 1089369 | | 4/2001 | |
| GB | 2334531 | | 8/1999 | |
| JP | 57184892 | A * | 11/1982 | F28F/3/02 |
| JP | 05212353 | A * | 8/1993 | |
| WO | 9619298 | | 6/1996 | |

* cited by examiner

*Primary Examiner*—Tho V Duong
(74) *Attorney, Agent, or Firm*—Baker Botts L.L.P.

(57) ABSTRACT

A heat exchanger includes an aluminum member coated with a resin. The resin-coated aluminum member may be formed as a constituent part, e.g., a heat transfer member, a heater core, or the like, of the heat exchanger. In such heat exchangers, the aluminum member is connected to other resin-coated aluminum members by fusing the resin. Energy consumed during the connection of the aluminum members of the heat exchanger may be effectively reduced, and the manufacturing cost of the heat exchanger may be reduced, compared with that of heat exchangers made according to known methods that use a brazing filler metal.

9 Claims, 3 Drawing Sheets

HEAT EXCHANGERS

BACKGROUND OF THE INVENTION

1. Field of the Invention

The present invention relates to heat exchangers used in automotive air systems. More particularly, this invention relates to heat exchangers manufactured from resin-coated members and to methods for manufacturing such heat exchangers.

2. Description of Related Art

Many of the constituent parts of known heat exchangers in automotive air systems, e.g., heat transfer members, heater cores, or the like, are made of aluminum, e.g., aluminum alloys, to facilitate heat transfer and to reduce heat exchanger weight. Such known heat exchangers comprise constituent parts made of aluminum members and may be manufactured according to the following process. A brazing filler metal is clad to a surface or surfaces of an aluminum member. The melting point of the brazing filler metal is lower than the melting point of the aluminum member. The aluminum member may be combined with other aluminum members to form a heater core of a heat exchanger. Some or all of the aluminum members may be clad with the brazing filler metal. Each aluminum member is formed and shaped. After the aluminum members are assembled, they may be heated in a furnace until the brazing filler metal melts. As a result, aluminum members constituting the core of a heat exchanger are connected together. By this method, the core of a heat exchanger may be manufactured.

In known heat exchangers used in automotive air systems manufactured as described above, the melting temperature of the brazing filler metal is at about 600° C. Therefore, the temperature of a furnace used to heat the aluminum members is increased to about 600° C. or higher.

Further, in known heat exchangers used in automotive air systems, a flux may be sprayed on the aluminum members that are to be connected using brazing filler metals to form the heat exchangers. The flux promotes the brazing connection between the aluminum members, e.g., by removing oxides from or preventing the formation of oxides on the surfaces to be joined, by facilitating the melting of the brazing filler metals, or the like. Therefore, the manufacturing cost of such heat exchangers may be increased due to the expense of providing a flux spray and due to an increase in the amount of manufacturing time needed for spraying the flux. Moreover, if the flux is sprayed unevenly or imprecisely, the connection formed between the aluminum members by brazing may be incomplete or of insufficient strength, e.g., due to the presence or formation of oxides that impede the connection of the aluminum members, by the uneven melting and flow of the brazing filler metals. Further, the heat exchangers formed by such incompletely-brazed aluminum members may have to be disposed of instead of being shipped, or they later may be recalled from the market or from customers. Moreover, repair of heat exchangers made of aluminum members that are not connected properly, e.g., due to an uneven or an imprecise flux spray, may be necessary.

In addition, in known heat exchangers used in automotive air systems, the aluminum members of some constituent parts, e.g., heater cores, may be in contact with water. As a result, corrosion preventing compounds may be clad to those aluminum members that are in contact with water. This cladding is employed to increase the resistance of the surface of these aluminum members to corrosion. As a result, the cost of the heat exchanger may increase. Further, each of the clad aluminum members of the heat exchanger may be formed by a die press. In such cases, reduced friction between the aluminum members of the heat exchanger and the die press is important in order to improve the quality of the formed aluminum members. A lubricant, e.g., lubricating oil, may be used to reduce friction and to enhance relative movement between the aluminum members and the die press. Consequently, the lubricant may be sprayed on the aluminum members. Nevertheless, this lubricant may have to be removed, e.g., cleaned, from the aluminum members after their formation in a die press. As a result, the manufacturing time of the heat exchanger may increase, as well as the cost of manufacturing the heat exchanger due to the need to provide a lubricant and to later remove the lubricant from the aluminum members.

SUMMARY OF THE INVENTION

A need has arisen for heat exchangers that may be manufactured by methods that consume less energy than known methods for manufacturing heat exchangers. A further need has arisen to reduce or eliminate problems that may be encountered in the manufacture of known heat exchangers using a sprayed flux and brazing filler metals. A still further need has arisen for heat exchangers that may be manufactured by methods, in which the temperature of a furnace that is used to heat the aluminum members for brazing need not be increased to about 600° C. or higher to melt the brazing filler metals, as is common in known heat exchangers and known methods of making those heat exchangers.

In an embodiment of this invention, a heat exchanger may comprise an aluminum member coated with a resin. Moreover, at least one constituent part of the heat exchanger comprises one of the aluminum members.

In another embodiment of this invention, a method for manufacturing a heat exchanger comprises the following steps. A surface of an aluminum member is coated with a resin. The aluminum member is cut to a predetermined size. The aluminum member is connected to another resin-coated aluminum member by fusing the resin.

In still another embodiment of this invention, a method for manufacturing a heat exchanger comprises the following steps. A surface of an aluminum member is coated with a resin. The aluminum member is formed, e.g., die pressed, as a constituent part of the heat exchanger. The aluminum member is cut to a predetermined size. The aluminum member is connected to another resin-coated aluminum member by fusing the resin.

Other objects, features, and advantages of embodiments of this invention will be apparent to and understood by persons of ordinary skill in the art from the following description of preferred embodiments.

BRIEF DESCRIPTION OF THE DRAWING

The present invention may be more readily understood with reference to the following drawing.

DETAILED DESCRIPTION OF PREFERRED EMBODIMENTS

Embodiments of a heat exchanger of the present invention used in automotive air systems are explained, as follows. In the present invention, aluminum members, which are coated with a resin, may be formed, e.g., die pressed, as constituent parts of a heat exchanger, e.g., a heat transfer member, a heater core, or the like. A thermoplastic resin or a thermosetting resin may be used for coating the aluminum members. Moreover, a resin having lubricity is coated, e.g., applied or clad, to the aluminum members. The aluminum members further may be molded in a die press.

Figure 1:
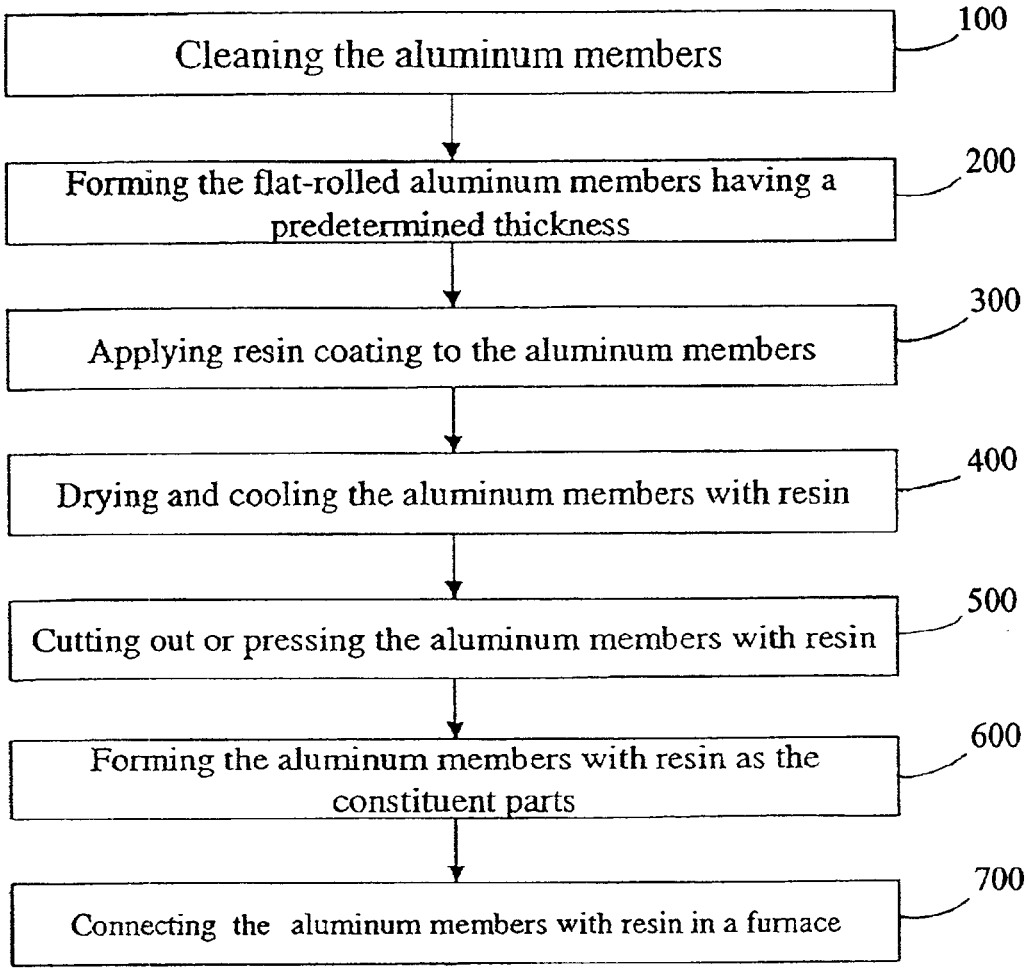
FIG. 1 shows a method of manufacturing a heat exchanger according to the present invention.
Figure 2:
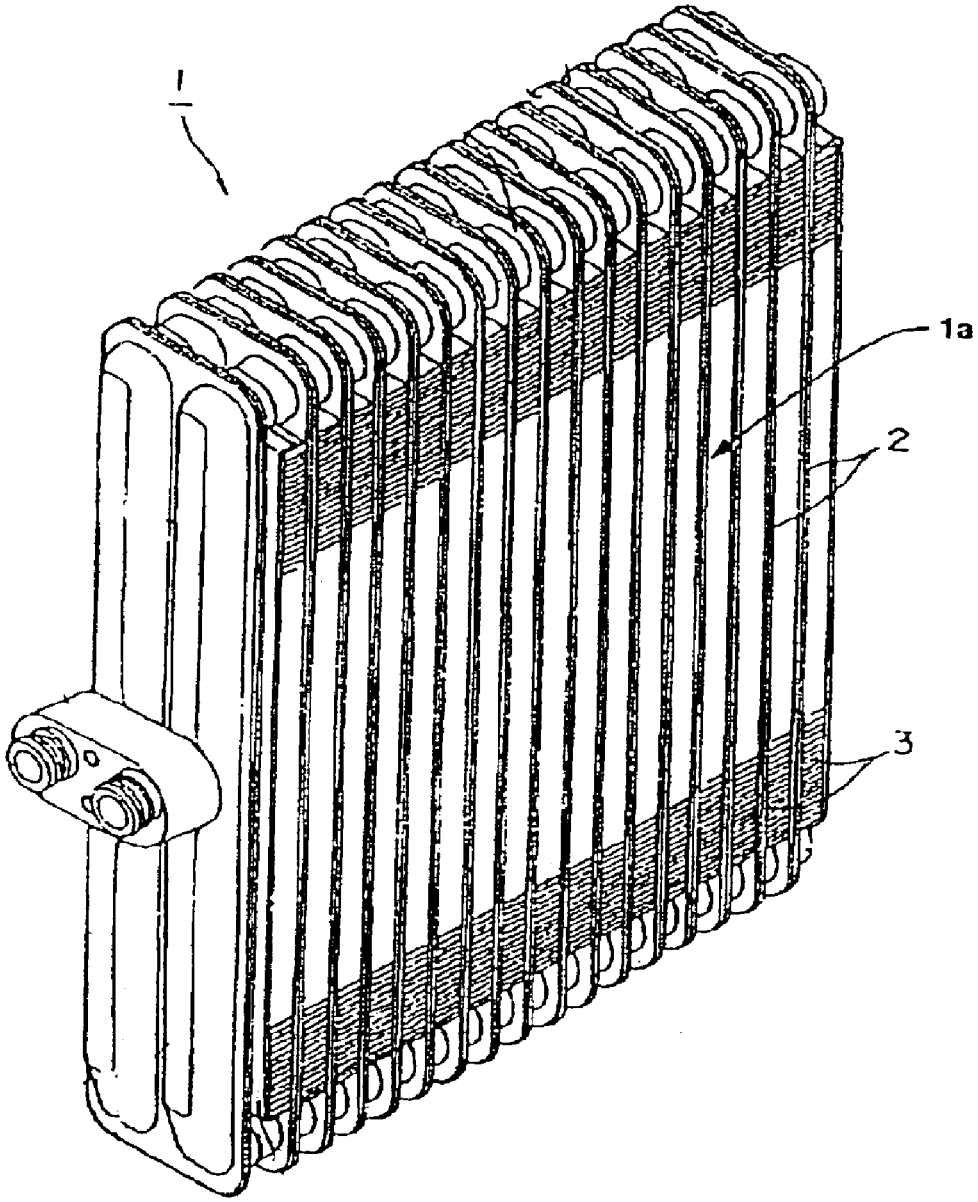
FIG. 2 is a heat exchanger according to an embodiment of the present invention.

Referring to FIG. 1, a heat exchanger 1 may comprise a plurality of heat transfer tubes 2 and a plurality of outer fins 3, such that heat transfer tubes 2 and outer fins 3 are alternately stacked. Each heat transfer tube 2 and the corresponding outer fin 3 form a heat exchanger core 1*a*.

Figure 3:
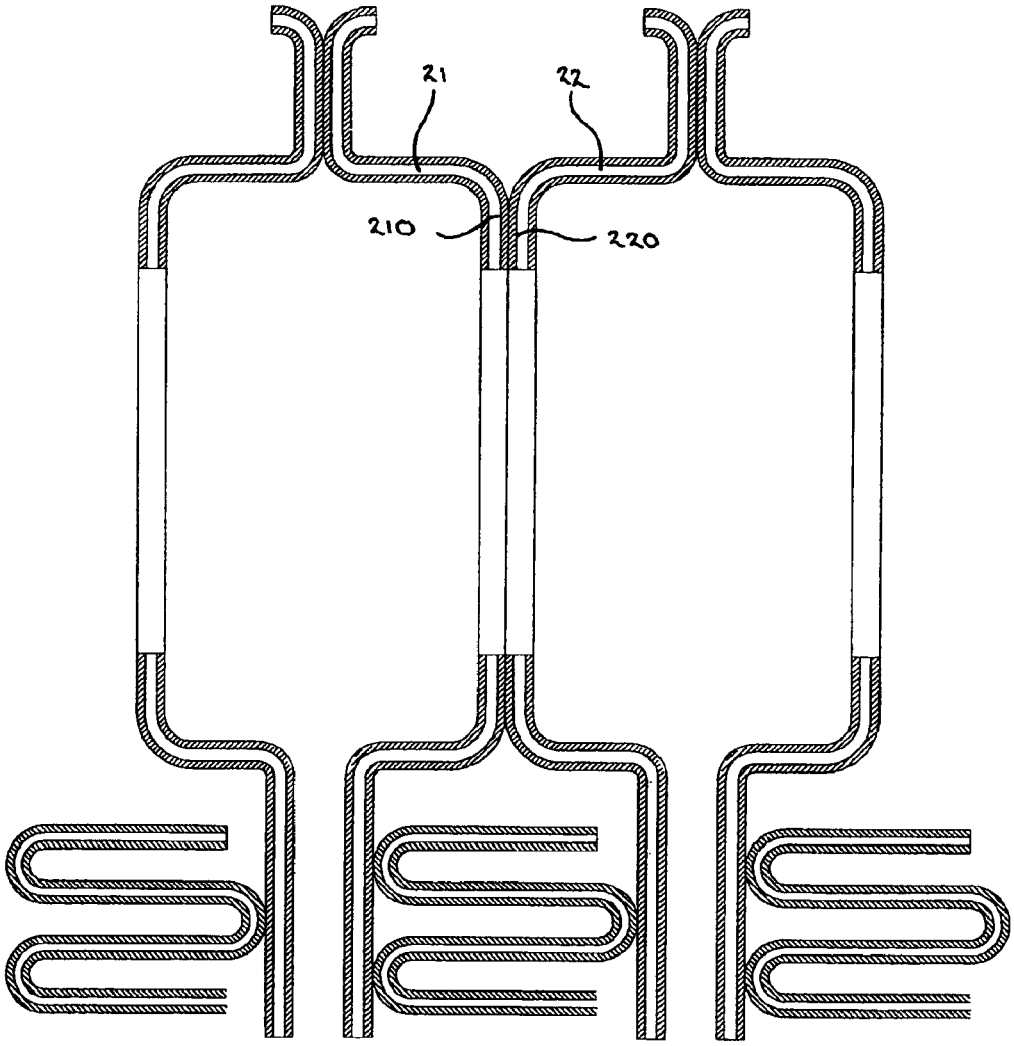
FIG. 3 depicts a first aluminum member fixed to a second aluminum member, wherein the members at separated by a first portion of a resin coating and a second portion of a resin coating.

As shown in FIG. 1 the resin-coated aluminum members may be manufactured in the following manner. Aluminum members are cleaned (step 100). After they are cleaned, the aluminum members may be formed, e.g., flat-rolled or the like, according to a predetermined thickness (step 200). A resin coating may be applied to at least one surface of the aluminum members (step 300). The resin-coated aluminum members may be dried and cooled (step 400). The aluminum members then may be rolled into a coil-shape. The resin-coated aluminum members are cut out to a predetermed size for each of the constituent parts, eg., a heat transfer member, a heater core, or the like, of the heat exchanger (step 500). Each member may be pressed, drilled, or drawn, as necessary (step 600). Alternatively, the aluminum members may be cut out to a predetermined size or each of the constituent parts of the heat exchanger after the resin-coated aluminum members are pressed, drilled, or drawn, or the like (not shown). After each of the aluminum members of the heat exchanger are formed as constituent parts, e.g., a heat transfer member, a heater core, or the like, of the heat exchanger, the aluminum members are placed in a furnace, in which they are fused together (step 700). In the furnace, the temperature is increased to a melting temperature or a softening temperature, as appropriate, of the coating resin or to a higher temperature. The aluminum members are thereby connected together by fusing the resin coating on each of the aluminum members to form the constituent parts, e.g., a heat transfer member, a heater core, or the like, of the heat exchanger. Referring to FIG. 3, a first aluminum member 21 fixed to a second aluminum member 22, wherein the fixed members are separated by a first portion 210 of a resin coating and a second portion 220 of a resin coating. Because a resin is used to join the aluminum members, the temperature of the furnace is increased to, and maintained at, a melting point or a softening point, as appropriate, of the selected resin. The melting point or the softening point of a suitable resin generally falls within a range between about 90° C. and about 300° C. Because the melting point or the softening point of these resins is lower than the melting point of known brazing filler metals, the temperature of the furnace need not be increased to about 600° C., as is common for melting brazing filler metals used in known heat exchangers. As result, energy consumption of the furnace may be reduced effectively by the use of resins. Moreover, the manufacturing cost of the heat exchangers, according to the present invention, also may be reduced due to the reduced energy consumption of the furnace.

In the present invention, because resins are used to join the aluminum members, flux does not have to be sprayed on the aluminum members, as is common with known methods that use brazing filler metals. Therefore, the time needed for spraying flux, as well as the cost of spraying flux, may be eliminated. Moreover, the possibility of forming an incomplete or insufficiently-strong connection, which may result from an imprecise or an uneven flux spray in known methods that use brazing filler metals, may be eliminated. As a result, disposing of, recalling, or repairing defective heat exchangers that have incompletely-brazed connections or connections of insufficient strength resulting from, e.g., the presence or formation of oxides, the uneven melting or flowing of brazing filler metals, or the like, due to an uneven or imprecise flux spray, may be eliminated. Further, the overall cost of manufacturing heat exchangers according to the present invention may be reduced, as well.

In addition, if the aluminum members are formed as heat exchanger constituent parts that come into contact with water, e.g., a heater core, or the like, those aluminum members of the heat exchanger that are in contact with water may require some form of corrosion protection. In known heat exchangers, cladding comprising an anti-corrosion material may be applied on those aluminum members that are in contact with water, or the thickness of the aluminum members may be increased to better withstand corrosion. In the present invention, on the other hand, because the resin coating on the aluminum members that form constituent parts of the heat exchanger provides corrosion protection, adding an anti-corrosion material to the aluminum members may not be necessary. Therefore, corrosion resistance of the heat exchanger of the present invention may be achieved by using aluminum members coated with a resin that provides protection against corrosion. As a result, the manufacturing cost of the heat exchanger may be reduced. Moreover, because the anti-corrosion properties of the heat exchanger and its constituent parts may be improved or ensured through the use of a resin coating on the aluminum members, the thickness of the aluminum members need not be increased in order to improve their corrosion resistance. Accordingly, the amount of aluminum needed for the manufacture of the aluminum members may be reduced, and the manufacturing cost of the heat exchanger may be reduced further. Moreover, by providing aluminum members of reduced thickness, the weight of the heat exchanger may be reduced effectively.

In addition, in known heat exchangers, if the aluminum members are molded with a die press to form constituent parts of a heat exchanger, lubricating oil or another lubricant may be used to permit or enhance relative movement, and to reduce friction, between the aluminum members and the die press. After formation of the aluminum members in the die press, the aluminum members may be cleaned, e.g., degreased. On the other hand, in the present invention, because the aluminum parts are coated with a resin that has lubricity, the resin-coated aluminum members have increased lubricity. As a result, the use of an additional lubricant during formation of the aluminum members in the die press no longer is necessary. Moreover, it is not necessary to clean the aluminum members after they are formed into constituent parts of the heat exchanger in the die press. As a result, the manufacturing cost of the heat exchanger may be reduced further.

A variety of resins may be used to coat the aluminum members that form constituent parts of the heat exchanger. Suitable resins used to coat the aluminum members of a heat exchanger include, e.g., a polyester resin, a nylon resin, a vinylidene fluoride resin, and similar thermoplastic and thermosetting resins. The softening point of a polyester resin may be in a range between about 165° C. and about 185° C. The melting point of a nylon resin may be in a range between about 95° C. and about 130° C. Moreover, the melting point of a vinylidene fluoride resin may be in a range between about 250° C. and about 270° C. Therefore, the temperature of the furnace, which is used to join the aluminum members by fusing the resin, may be set in accordance with the softening point or melting point, as appropriate, of each of the resins that are used.

A resin coating may be applied to a surface or surfaces of each aluminum member. The resin coating may be applied to a particular surface, or to particular surfaces, of an aluminum member depending upon the particular constituent part of a heat exchanger, into which the aluminum member is to be formed, e.g., a heat transfer member, a heater core, or the like. The thickness of the resin coating preferably is in a range between about 5 μm and about 50 μm. Resin spraying may be employed to provide a uniform thickness resin coating and to reduce the amount of resin that is used to coat the aluminum members.

The invention may be further clarified by a consideration of the following examples, which are intended to be purely exemplary of the use of the invention. In the present invention, the strength of the connections between the aluminum members coated with a resin may be increased compared with the connections formed by known brazing filler metals. The following examples are provided to demonstrate the strength of connections formed between resin-coated aluminum members.

Flat, plate-shaped aluminum members, having a width of about 30 mm, were formed. The edges of two flat, plate-shaped aluminum members were overlapped along a length of about 50 mm and a width of about 30 mm. The aluminum members were coated with a resin and then connected by fusing the resin coatings. After the aluminum members were connected, the strength of the connection between the members was measured by pulling both sides of the connected members apart using a tensile test machine.

Three different resins were used for the resin coating. The resins used were a polyester resin (softening point: about 180° C.), a nylon resin (melting point: in a range between about 95° C. and about 130° C.), and a vinylidene fluoride resin (melting point: about 260° C.). Each of the resins was coated on a separate pair of aluminum members. The polyester resin was coated in one layer on each surface of one pair of flat, plate-shaped aluminum members to a thickness of about 5 μm. The nylon resin was coated in one layer on each surface of another pair of flat, plate-shaped aluminum members to a thickness of about 5 μm. An epoxy resin was sprayed for a first coat on a third pair of flat, plate-shaped aluminum members. Subsequently, the vinylidene fluoride resin was coated in two layers on each surface of the third pair of aluminum members to a thickness of about 20 μm. After each pair of aluminum members was coated with a respective resin (i.e., two aluminum members coated with a polyester resin, two aluminum members coated with a nylon resin, and two aluminum members coated with an epoxy and a vinylidene fluoride resin), the aluminum members of each pair were overlapped, as described above. Subsequently, each of the two overlapped aluminum members was placed in a furnace under the conditions that appear in the following table to fuse the aluminum members together. After the fused aluminum members were cooled, a tensile test was performed on each of the respective, connected aluminum members. The test was performed three times on each of the fused members, and the following average values for the strength of each of the connections were obtained. These results appear in the following table.

| Coating | Temperature | Heating Time | Tensile Strength |
|---|---|---|---|
| Polyester Resin | 200° C. | 20 minutes | 54 N/mm$^2$ |
| Nylon Resin | 150° C. | 3 minutes | 50 N/mm$^2$ |
| Vinylidene Fluoride Resin | 260° C. | 20 minutes | 65 N/mm$^2$ |

Thus, the heat exchanger formed by fusing aluminum members coated with a resin may achieve extensive reductions in manufacturing cost, a simplified manufacturing process, and a high strength of connection between the aluminum members.

The present invention may be suitable for a stacked-type heat exchanger, which has a plurality of heat transfer tubes and a plurality of fins stacked alternately. The heat transfer tubes and fins may be stacked together and connected by fusing a resin coating on the heat transfer tubes and the fins at a lower temperature than is common using known methods with brazing filler metals. Thus, the present invention reduces the energy consumption in the furnace compared with known methods of making heat exchangers. Moreover, the present invention may be suitable for a heat exchanger having a plurality of heat transfer tubes, each of which is formed by a pair of tube plates. The flange portions of each pair of tube plates are fused together. Moreover, the pair of tube plates may be fused efficiently in the furnace at a lower temperature than is used in known methods. Because the resin is coated uniformly on the aluminum members, the pair of tube plates is connected with uniformity along the length of the tube plates. As a result, seal efficiency of the fused tube plates may be increased. Moreover, because a high fusion strength is achieved between the aluminum members, as disclosed in the above-described examples, heat exchangers according to the present invention may operate at higher pressures than known heat exchangers that are made using known methods.

As described above, in a heat exchanger for use in an automotive air system with respect to embodiments of the present invention, the energy consumed during connection of the aluminum members of the heat exchanger may be effectively reduced, and the manufacturing cost of the heat exchanger may be reduced, as well. Moreover, spraying flux upon the aluminum members, which is common in known methods that use brazing filler metals, is not necessary. Therefore, the cost of the manufacturing time for spraying flux, in addition to the cost of flux, may be eliminated. Moreover, the possibility of forming an incomplete or an insufficiently-strong brazing connection, which may accompany an uneven or an imprecise flux spray using known methods, may be eliminated. Further, the use of a lubricant on aluminum members, and a solvent to remove lubricant from each of the aluminum members, is no longer necessary. Consequently, the manufacturing cost of the heat exchanger again may be reduced.

Although the present invention has been described in connection with preferred embodiments, the invention is not limited thereto. It is intended that the specification and examples be considered as exemplary only, with the true scope and spirit of the invention being indicated by the following claims. It will be understood by those skilled in the art that other embodiments of the invention, variations and modifications will be apparent to those skilled in the art from a consideration of this specification or a practice of the invention disclosed herein, and may be made within the scope and spirit of this invention, as defined by the following claims.

What is claimed is:

1. A heat exchanger comprising:

a first aluminum member, all surfaces of which are coated with a first portion of a resin; and a second aluminum member, all surfaces of which are coated with a second portion of said resin, wherein said first aluminum member is fixed to said second aluminum member via said first portion of said resin and said second portion of said resin, and wherein said first aluminum member is separated from said second aluminum member by said first portion of said resin and said second portion of said resin, and wherein said heat exchanger is a stacked-type heat exchanger having at least one heat transfer tube and at least one fin, said at least one heat transfer tube and said at least one fin being stacked alternately.

2. The heat exchanger of claim 1, wherein at least one constituent part of said heat exchanger comprises aid first aluminum member and said second aluminum member.

3. The heat exchanger of claim 1, wherein said at least one heat transfer tube is formed by a pair of tube plates, such that flange portions of said pair of tube plates are connected.

4. The heat exchanger of claim 1, wherein each of said first and second portions of said resin is a thermoplastic resin.

5. The heat exchanger of claim 1, wherein each of said first and second portions of said resin is a thermosetting resin.

6. The heat exchanger of claim 1, wherein each of said first and second portions of said resin provides lubricity.

7. The heat exchanger of claim 1, wherein each of said first and second portions of said resin is a polyester resin.

8. The heat exchanger of claim 1, wherein each of said first and second portions of said resin is a nylon resin.

9. The heat exchanger of claim 1, wherein each of said first and second portions of said resin is a vinylidene fluoride resin.

* * * * *